US005190199A

United States Patent [19]

Bulger et al.

[11] Patent Number: 5,190,199

[45] Date of Patent: Mar. 2, 1993

[54] DISPENSING CARTON WITH CUTTING MEANS PROTECTOR

[75] Inventors: Wayne Bulger, Tinley Park; Chih-Hung Chen, Naperville, both of Ill.

[73] Assignee: First Brands Corporation, Danbury, Conn.

[21] Appl. No.: 706,143

[22] Filed: May 28, 1991

[51] Int. Cl.[5] ..... 225 20; 225 43; 225 50; B26F 3/02

[52] U.S. Cl. ..... 225/1

[58] Field of Search ..... 225/19, 20, 39, 43, 225/50, 1, 48; 206/395, 408, 409

[56] References Cited

U.S. PATENT DOCUMENTS

| | | | |
|---|---|---|---|
| 2,303,253 | 11/1942 | Broeren | 225/43 |
| 3,531,032 | 9/1970 | Miles, Jr. | 225/48 |
| 3,552,614 | 1/1971 | Wilson et al. | 225/48 X |
| 3,722,767 | 3/1973 | Struble | 225/49 |
| 4,307,828 | 12/1981 | Sias et al. | 225/48 X |
| 4,648,536 | 3/1987 | Vanderlugt | 225/43 |
| 4,972,984 | 11/1990 | Frank et al. | 225/20 |

*Primary Examiner*—Eugenia Jones
*Attorney, Agent, or Firm*—Gary L. Wamer

[57] ABSTRACT

A dispensing carton for a roll of sheet material, the dispensing carton having a bottom, front, rear and end walls, a lid hingedly connected to the rear wall forming an elongated aperture between the lid and the front wall for withdrawing a sheet material from a roll of sheet material positioned within the dispensing carton. The lid comprises a first panel and a second panel, the first panel extending from said rear wall to the front wall with the second panel overlapping the front wall of the dispensing carton and having a cutting bar with a cutting edge affixed to the surface of the second panel, the second panel having a top edge and a bottom edge with a hinge line placed therebetween whereby said second panel may be bent along the hinge line to form a cutting bar support panel and a cutting edge protector panel at the hinge line adjacent the cutting bar having a cutting edge. The hinge line connects a first front panel portion and a second front panel portion and is located behind the cutting edge of the cutting bar whereby the second front panel portion overlays the cutting edge to provide a cutting edge protector panel portion.

16 Claims, 5 Drawing Sheets

FIG. 1
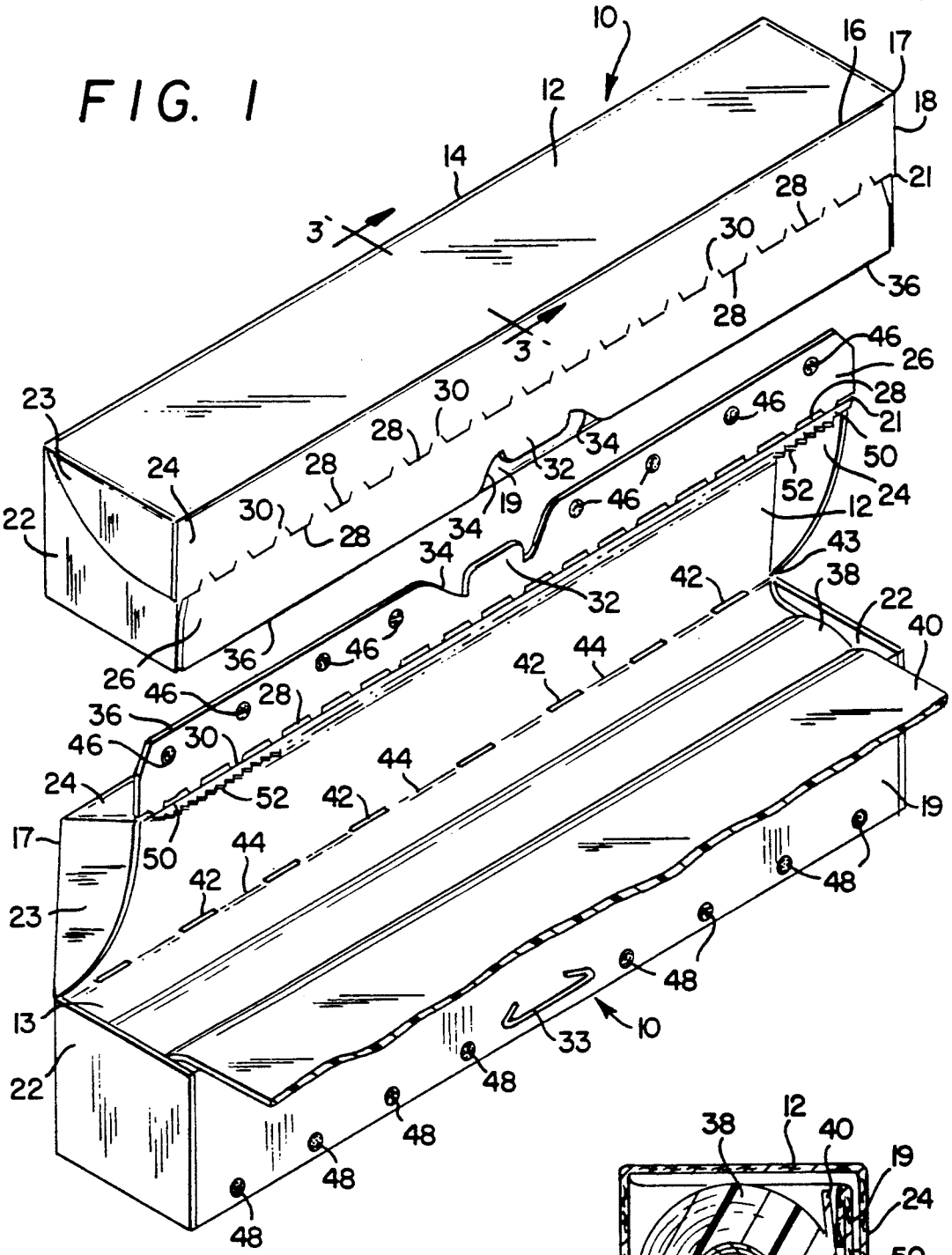
FIG. 2
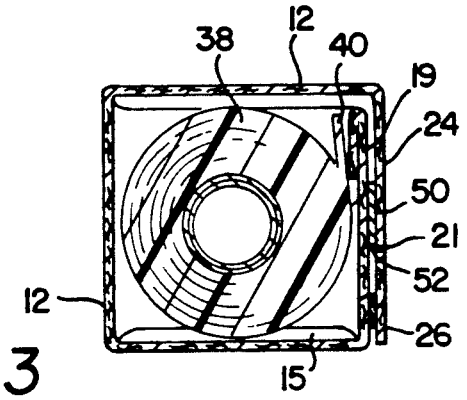
FIG. 3

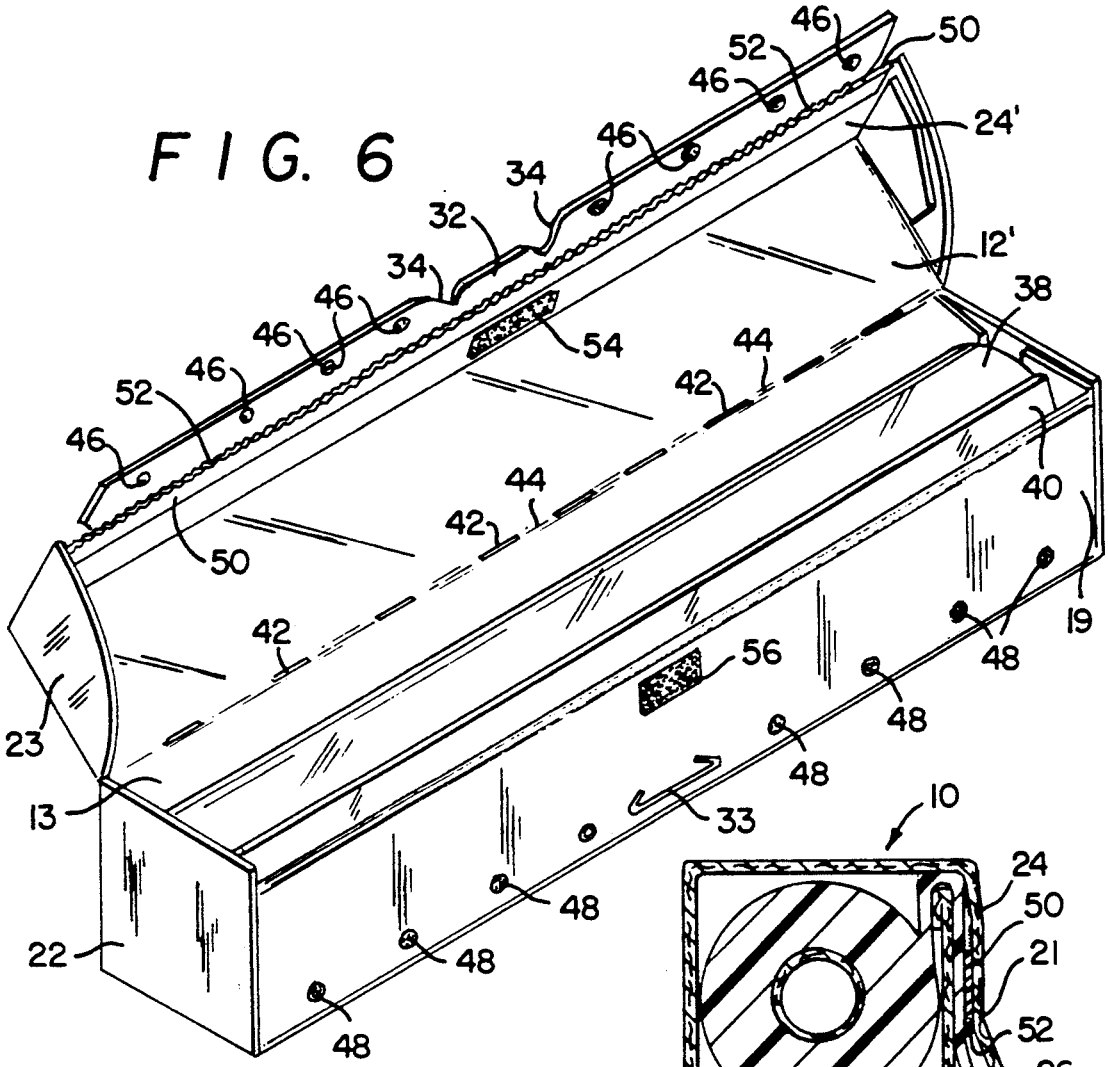
FIG. 6
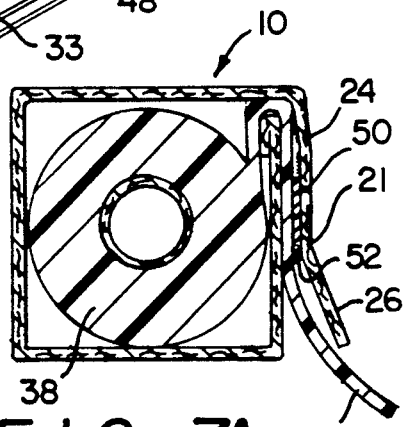
FIG. 7A
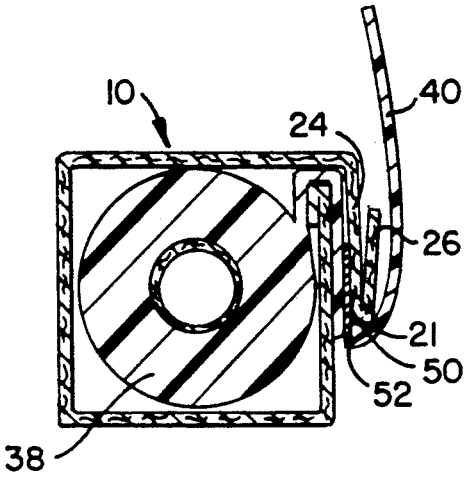
FIG. 7B
FIG. 7C
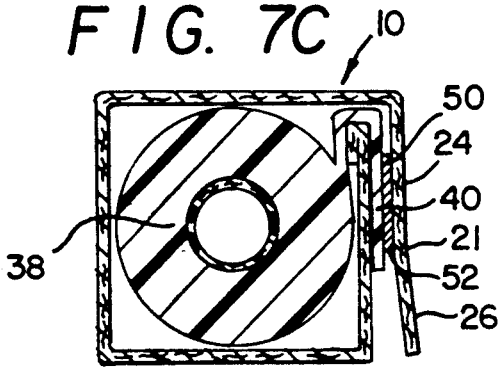

DISPENSING CARTON WITH CUTTING MEANS PROTECTOR

BACKGROUND OF THE INVENTION

The instant invention relates to a dispensing carton for dispensing a roll of sheet material such as polymeric materials where the dispensing carton has a cutting means and a cutting means protector for severing preselected lengths of the sheet material from a roll of sheet material.

The prior art relating to dispensing cartons for dispensing a roll of sheet material extends over several decades and relates to dispensing rolls of sheet material wherein the sheet material may be paper, metal foil or a polymeric film material. Representative patents relating to dispenser cartons with cutter bars include:

| U.S. Pat. No. | PATENTEE |
|---|---|
| 2,115,887 | Spilski |
| 3,227,340 | Haley |
| 3,531,032 | Mile, Jr. |
| 3,552,614 | Wilson |
| 3,613,973 | Joeschke |
| 3,722,767 | Struble |
| 4,307,828 | Sias et al. |

Of the above patents the Miles, Jr. and Struble patents show dispenser cartons with cutter bars affixed to the top edge of the front wall with a cover which overlays the cutter bar when the cover is in a closed configuration. Of interest is Sias et al. wherein a dispenser carton is disclosed having an exposed cutter bar located on the front panel of the cover of the dispensing carton whereby a segment of the roll sheet material may be severed from the roll by pulling it across the exposed cutter bar.

Of the aforementioned patents the Wilson patent addresses the additional issue of providing means for protecting the user of the dispensing carton from the cutting edge of the cutter bar. Wilson provides a dispensing carton with the cutter bar mounted on the top edge of the front wall of the dispensing carton with a substantially L-shaped shield for the cutting edge. The L-shaped shield is made of a resilient material which overlays the cutter bar during non-use and when in use is deflected away from the cutter bar by the sheet material. Although Wilson provides a useful protective shield for a front panel mounted cutter bar, the configuration of the patent is not useful for cover mounted cutter bars. Further, the protective shield requires the resiliency of the material forming the protective shield to retain its position overlapping the cutter bar after repeated use. Further, the action which deflects the protective shield is the action of the sheet being unwound from the roll at a required angle of contact of the sheet material and the protective shield. Proper control of this contact angle by a user is not certain and when not achieved will result in improper cutting of the sheet material by the cutter bar.

Review of the aforementioned patents demonstrates that little development or consideration has been made to date in providing a dispensing carton for a roll of sheet material having a cutter bar with a cutting edge for a sheet material and having a protection means for the cutting edge whereby the user of the dispensing carton is protected from the cutting edge when accessing the dispensing carton and during use of the dispensing carton for dispensing a sheet material.

SUMMARY OF THE INVENTION

The instant invention relates to a dispensing carton for a roll of sheet material, the dispensing carton having a bottom, front, rear and end walls, a lid hingedly connected to the rear wall forming an elongated aperture between the lid and the front wall for withdrawing a sheet material from a roll of sheet material positioned within the dispensing carton. The lid comprises a first panel and a second panel, the first panel extending from said rear wall to the front wall with the second panel overlapping the front wall of the dispensing carton and having a cutting means with a cutting edge affixed to the surface of the second panel, the second panel having a top edge and a bottom edge with a hinge line placed therebetween whereby said second panel may be bent along the hinge line to form a cutting means support means and a cutting edge protector means at the hinge line adjacent the cutting means having a cutting edge. The hinge line which connects the upper first panel portion and lower second panel portion is located behind the cutting edge of the cutting means whereby the lower second panel portion overlays the cutting edge to act as the cutting edge protector means.

BRIEF DESCRIPTION OF THE DRAWINGS

FIG. 1 is an isometric front view of a dispensing carton according to the instant invention showing the lid in a closed configuration;

FIG. 2 is a front view of the dispensing carton of FIG. 1 showing the lid open;

FIG. 3 is a transverse sectional view taken along line 2—2 of FIG. 1;

FIG. 6 is a dispensing carton according to FIG. 1 showing additional features; and FIGS. 7A, 7B and 7C are transverse sectional views taken along line 2—2 of FIG. 1 showing stepwise dispensing of a sheet material from the dispensing carton.

DETAILED DESCRIPTION OF THE INVENTION

Figure 4:
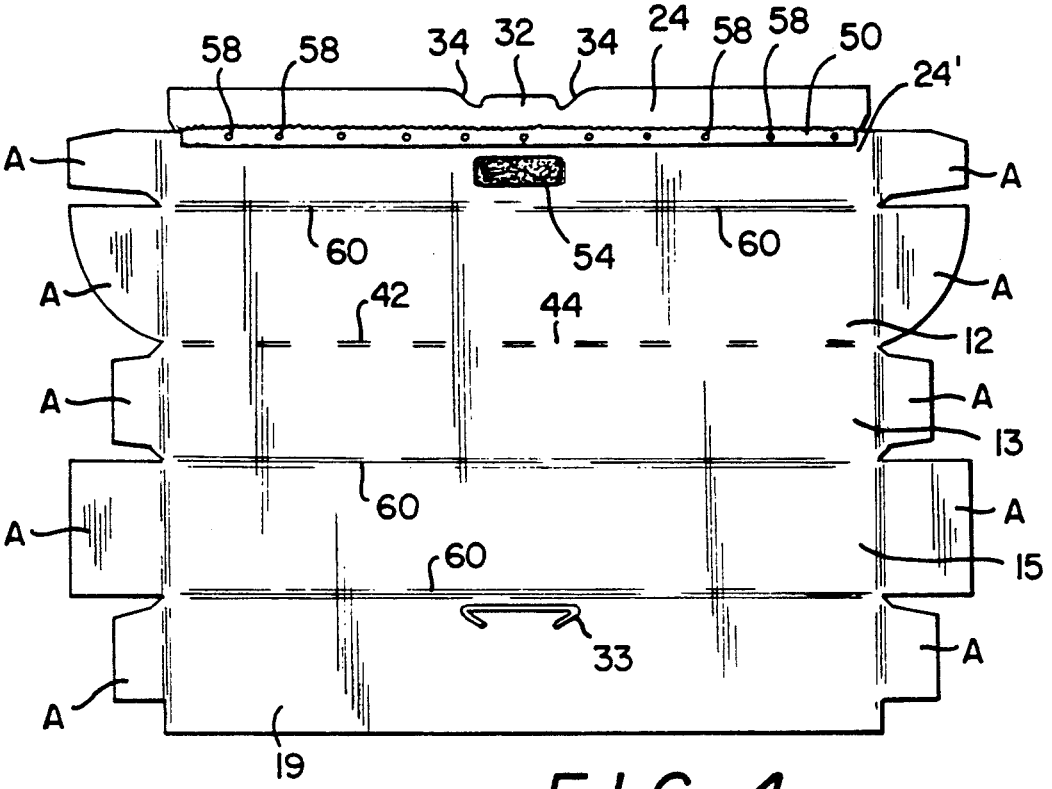
FIG. 4 is a plan view of the blank used to make the dispensing carton of FIG. 1.

The instant invention addresses the safety problem associated with the use of dispensing cartons having cutting means, e.g., cutter bars, wherein the user of such dispensing cartons may be cut during use of the dispensing carton. Since the reason for placement of a cutter bar on a dispensing carton is to cut the sheet material, the cutter bar must have a cutting edge suitable for this purpose. Inherent in achieving this purpose is that the cutting edge may also cut the fingers (including thumb) of the user while picking up the dispensing carton from a counter or a drawer or when using the dispensing carton for dispensing a selected length of sheet material. This ability of the user to cut his/her finger results from the exposed nature of the cutting edge of the cutting bar. For example, the dispensing carton shown in FIG. 1 of U.S. Pat. No. 4.,307,828 (Sias et al.) shows exposed cutting edge 90. This exposed cutting edge provides an opportunity for an unwitting user to inflict a cut on a finger.

The instant invention prevents this opportunity to inflict a cut to a user's finger by providing a protector means which overlays the cutting edge of the cutter bar. In this manner the cutting edge is prevented from coming into contact with the finger of a user when the dispensing carton is both picked up and when used for dispensing a preselected amount of sheet material.

In one embodiment, another feature of the instant invention is the cost efficient manner in which this safety feature may be provided to prior art dispensing cartons. As is well know, prior art dispensing cartons have generally placed the cutter bar on the bottom, front edge of the dispensing carton. The dispensing cartons have generally been provided with a "truck-type" lid with a portion of the lid overlapping the front wall of the dispensing carton with a bottom tear-off strip for removal so as to provide access to the roll of sheet material in the dispensing carton and for access to the cutter bar. The bottom tear-off strip has been extended in some instances to extend over the cutting edge of the cutter bar so as to protect consumers at the point of purchase from the cutting edge. Unfortunately, during the first use of the product the tear-off strip is removed for accessing the roll of sheet material and concurrently exposes the cutting edge of the cutter bar. The instant invention overcomes this problem by relocating the cutter bar on the surface of the front panel of the lid and by providing a protector means which overlays the cutting edge of the cutter bar. The previous line of perforations employed to facilitate removal of the tear-off strip from the front panel of the lid is repositioned as a hinging line of perforations to provide a two portion front panel of the lid with a lower front panel portion capable of outward deflection along the hinging line perforations at a line of hinge movement located behind the cutting edge of the cutting bar. In this fashion an upper front panel portion of the front panel of the lid acts to support the cutter bar to which it is affixed while a lower front panel portion of the front panel acts to overlay the cutting edge of the cutter bar in both the closed and open configurations of the dispensing carton. The relative dimensions of the upper and lower front panel portions of the lid are preferably selected to expose only so much of the cutting edge of the cutter bar so as to provide a cutting action for the sheet material while also providing a lower portion of the front panel of sufficient width to overlay the cutting edge of the cutter bar and provide a protective cover for the cutting edge of the cutter bar. The hinge line between the first and second panel portions of the front panel of the lid is preferably placed at a vertical distance on the front panel of the lid at least one half the vertical distance of the front panel of the lid from its top edge to its bottom edge and will be located just behind the cutting edge of the cutter bar such that the lower portion of the front panel will provide a protector means for the cutting edge of the cutter bar. Further, from a functionality consideration placement of the hinge line should be such that when the protector means is deflected by a user's fingers the width of the protector means will be sufficient to deflect the user's finger(s) away from the cutting edge of the cutting bar so as to position the user's fingers whereby the user will decrease the likelihood of cutting a finger. The net result of this embodiment of the instant invention is that the lower front panel portion of the dispensing carton previously thrown away after first use of the dispensing carton as a "tear-off strip" is now used as a protector means for the cutting edge of the cutter bar.

As will be appreciated by those skilled in the art, the protector means discussed above need not be formed from a single piece of dispensing carton material, although this embodiment is economically attractive. In an alternative embodiment the front panel of the lid is formed from both the material of construction of the dispensing carton (upper front panel portion) and a "add-on member" for the lower portion of the front panel of the lid. This "add-on member" achieves the function of the protector means of this invention but may be provided in numerous variations. For example, a single unitary member may be provided as the lower portion of the front panel and have a cutter bar with a cutting edge affixed to its inner surface and a protector means may be hingedly connected behind the cutting edge and may be molded of a thermoplastic material and then affixed to the bottom edge of the upper portion of the lid's front panel. Alternatively, this add-on member may be two or more interconnected pieces having the functionality described herein. For example, the protector means may be a separate member which is interconnected to a cutter bar by appropriate affixing means which including biasing means to bias the protector means to overlay the cutting edge of the cutter bar, e.g., spring means. This member may then be affixed to the dispensing carton as above described by known affixing means.

The dispensing carton of the instant invention is the "trunk lid" style carton generally known in the trade. The instant invention relate to providing such a "trunk lid" style carton with a protector means for the cutting edge of the cutter bar by repositioning the cutter bar on the surface of the front panel of the lid and providing a cutting edge protector means which overlays the cutting edge of the cutter bar when the carton is in an open and/or closed configuration. The cutting edge protector means may be deflected when a selected length of sheet material is to be removed by the action of pulling the sheet material across the cutting edge of the cutter bar.

In general, the instant invention relates to a dispensing carton for a roll of sheet material from a dispensing carton comprising bottom, front, rear and end walls, a lid hingedly connected to the rear wall forming an elongated aperture between the lid and the front wall for withdrawing a sheet material from a roll of sheet material positioned within the dispensing carton. The lid comprises a first top panel and a second front panel, with the first top panel extending from the rear wall to the front wall and the second front panel overlapping the front wall of the dispensing carton for a distance of the front wall to provide a support panel for the cutting means. The second panel portion has a top edge and a bottom edge and has cutting means with a cutting edge affixed to the surface (preferably the inner surface) of the second panel along a hinge line placed between the top edge and bottom edge of the second front panel whereby the second panel may be bent at this hinge line to form a cutting means support means (or "upper front panel portion") and a cutting edge protector means (or "lower front panel portion"). The hinge line is adjacent the cutting edge of the cutting means, and provides a hinging action for the cutting edge protector means of the hinge line located behind the cutting edge.

The hinge line is characterized as providing a hinging function for the cutting edge protector means and is preferably formed by creating a length of spaced apart perforations in a unitary sheet of material forming the front panel of the lid. The length of the perforation and the length of carton material retained therebetween will be selected based upon the desired resistance to hinging or ease of hinging action. For example, when the length of the perforations is smaller the resistance to hinging is greater owing to the resistance to bending of a greater length of carton material remaining as a result of the smaller perforations. In one embodiment the line of weakness may be a scored line with no perforations whereby the scored line is the line along which the hinging action occurs. In another embodiment the perforations are three sided perforations as heretofore employed in the prior art for the line perforation for tear strips.

The instant invention may also include carton locking means for securing the carton in a closed position after use, e.g., a tab means with mating slot means. Locking means of the tab/slot type are well known in commercial packaging. Further, film retaining means (e.g., adhesive means or vinyl adherence means) may be provided as adhesive means for retaining the leading edge of the sheet material and a protecting means for the adhesive means may be employed as hereto known and employed in the prior art, as exemplified in U.S. Pat. Nos. 3,549,066 and 4,307,828, incorporated herein by reference. Further, glue areas may be employed as hereto employed in the prior art to maintain the carton in a closed position prior to first use. Such are known in the art and representative thereof are "glue dots" as disclosed in U.S. Pat. No. 4,307,828.

Referring to FIG. 1, a dispensing carton 10 for a roll of sheet material according to the instant invention is shown in its erected and closed configuration comprising a plurality of walls foldably connected including a lid 17 (formed of top panel 12, front panel 18, two end lid walls 24 (only one shown) connected to rear wall 13 (shown in FIG. 2)), front wall 19 and two end walls 22 (only one shown). The front panel 18 of lid 17 comprises two panel portions, upper front panel portion 24 and lower front panel portion 26 on either side of a hinge line 21. Lid 17 is hingedly connected to adjacent edge 14 of rear wall 13 (shown in FIG. 2). Hinge line 21 is shown as a line of perforations 28 with carton material segments 30 between respective perforations 28. Perforations 28 are shown as three sided perforations but may be of any geometric design, including straight cuts. Upper front panel portion 24 and lower front panel portion 26 are connected at hinge line 21 which is positioned on the front panel between the top edge 16 of front panel 18 and bottom edge 36 of front panel 18. The actual position of hinge line 21 may vary with the selected use of dispensing carton 10 but is preferably greater than about 50% of the downward vertical distance from top edge 16 to bottom edge 36 but less than about 80% of such distance whereby the width of lower front panel portion 26 will have sufficient width to act as protector means for cutting edge 52. As noted above, the selection of the placement of the hinge line is related to the placement of cutter bar (not shown in FIG. 1) and to the width of lower front panel portion 26 which acts as protector means 26 for the cutting edge 52 of the cutter bar 50. Owing to the functionality of upper front panel portion 24 and lower front panel portion 26 such are also alternatively referred to herein as cutting means support means 24 and cutting edge protector means 26, respectively. Cutting edge protector means 26 is shown with optional tab 32 having cut-out areas 34 on either side thereof. Tab 32 may be provided for ease in opening the dispensing carton in initial opening of the dispensing carton 10 for accessing the roll of sheet material (not shown) in dispensing carton 10 and may also be part of locking means for dispensing carton 10 wherein the additional part of the locking means is a slot (not shown) on front wall 19 into which tab 32 may be inserted. One or more locking means may be provided for dispensing carton 10 depending on the size of dispensing carton 10 or the desired level of locking action desired for maintaining dispensing carton 10 in its closed configuration.

Referring to FIG. 2, dispensing carton 10 of FIG. 1 is shown in an open configuration with roll 38 of sheet material 40 shown as being unwound in a counter clockwise direction (may alternatively be unwound in the clockwise direction) as the sheet material 40 is dispensed from dispensing carton 10 as sheet material 40 is pulled from the roll 38 of sheet material 40. Lid 17 of dispensing carton 10 has hinge line 21 on front panel 18 connecting cutter bar support means 24 and cutting edge protector means 26. Hinge line 43 is shown in FIG. 2 as a three-sided line of perforations 42 with section of the carton material 44 therebetween. Cutting edge protector means 26 is shown in an outwardly deflected position from the cutting edge 52 of cutter bar 50 so as to show glue areas 46 on the inner surface of cutting edge protector means 26 which are aligned to mate glue areas 48 on the outer surface of front wall 19. When dispensing carton 10 is in a closed configuration (as shown in FIG. 1) glue areas 46 and glue areas 48 are aligned to provide points where lid 17 is in a fixed, closed position prior to rupturing of the glued interface for each aligned glue area 46 and glue area 48. Cutting edge protector means 26 is affixed to front panel 18 along hinge line 21 which is positioned behind cutting edge 52 of cutter bar 50 by a distance which permits cutting edge 52 to provide a sheet material cutting action when a preselected length of sheet material 40 is withdrawn from dispensing carton 10 and lid 17 is closed so as to having cutting edge 52 contact sheet material 40 to provide a cutting action whereby a length of sheet material 40 is severed from roll 38 of sheet material 40. FIG. 7A, 7B and 7C show the sequential steps involved in severing a preselected length of withdrawn sheet material 40 after lid 17 is closed. FIG. 7A shows a length of sheet material 40 extending a distance beyond the bottom edge of cutting edge protector means 26 which is shown deflected outwardly from cutter bar 50 as a result of contact with sheet material 40. Cutting edge protector means 26 is shown as outwardly deflected from the plane of cutter bar support means 24 and cutting edge 52 of cutter bar 50 at hinge line 21 whereby contact of sheet material 40 comes into contact with cutting edge 52. FIG. 7B shows the next step in the process wherein sheet material 40 is lifted in an upward direction as lid 17 of dispensing carton 10 is maintained in a closed position. As sheet material 40 is upwardly drawn, cutting edge protector means 26 is first outwardly deflected away from cutting edge 52 and then inwardly deflected inwardly towards cutter bar support means 24. Sheet material 40 then contacts cutting edge 52 to provide a severing action as film tension is provided at cutting edge 52 by the upward pull on sheet material 40. FIG. 7C shows the final closed configuration of dispensing carton 10 after the preselected length of sheet material 40 has been severed from roll 38 of the sheet material 40. Cutting edge protector means 26 has returned to its overlaying position over cutting edge 52 of cutter bar 50 as a result of biasing means at hinge line 21 or by the simple influence of gravity, both of which will act to deflect cutting edge protector means 26 from the position shown in FIG. 7B to a position substantially as shown in FIG. 7C.

Figure 8:
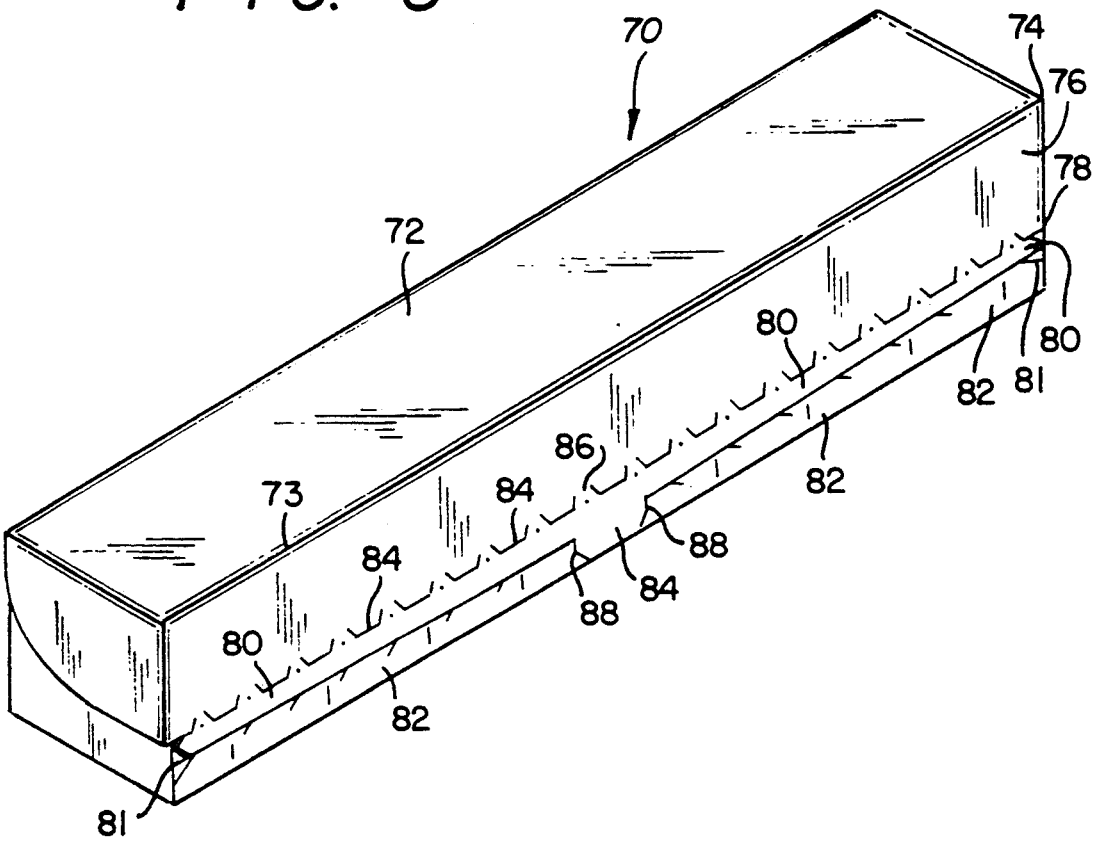
FIG. 8 is an isometric front view of a dispensing carton according to the instant invention showing the lid in a closed configuration with a tear-off strip.

Referring to FIG. 3, a transverse sectional view taken along line 2—2 of FIG. 1 shows dispensing carton 10 in a closed configuration with roll 38 of sheet material 40 within dispensing carton 10. Cutter bar support means 24 and cutting edge protector means 26 are shown connected at hinge line 21 which is located behind cutting edge 52 of cutter bar 50. Cutter bar support means 24 and cutting edge protector means 26 are shown as overlapping front wall 19 over substantially its entire length. Although such substantial overlap is preferred, it is within the scope of the instant invention to provide a front panel formed of cutter bar support means 24 and cutting edge protector means which is less than the length of front wall 19. The front panel must have sufficient length to provide a first front panel portion to support the cutter bar and provide a second front panel portion to act as the cutting edge protector means according to the instant invention. The combined width of these two front panel portions may be substantially less than the vertical width of the front wall and, in fact, may be less than one half the vertical width of the front wall of dispensing carton 10. For example, in one embodiment, referring to FIG. 8, the front panel 74 of the lid of the dispensing carton 70 may also have a tear-off strip 82. In this embodiment the lower portion of the front panel of the lid is provided with tear-off strip 82 whereby a portion of the front panel below hinge line 78 may be removed when opening dispensing carton 70 for the first time while at the same time a cutting edge protector means 80 is retained and connected at hinge line 78 and provides cutting edge protector means 80 according to the instant invention. The lower portion of the front panel below hinge line 78 will comprise cutting edge protector means 80 and tear-off strip 82 connected along tear-off line 81. FIG. 8 depicts a dual-type tear-off strip with tear-off strips 82 on either side of tab 84, although a single pieced tear-off strip may be employed. Tear-off strips 82 are removed from dispensing carton 70 by rupturing tear-off lines 81 and 88 whereby cutting edge protector means 80 and tab 84 are retained as elements of dispensing carton 70. Tear-off strips 82 will typically be affixed to the front wall (not shown) of dispensing carton 70 by glue areas which will be ruptured during the removal of tear-off strips 82. The other features of the dispensing carton shown in FIG. 8 may be as shown in FIGS. 1 through 7 hereof. In the embodiment shown in FIG. 8 it will be necessary to consider the propensity to rupturing of the line of perforations employed for the tear-off strip in comparison to any propensity of the hinge line to rupture. By proper selection of the form of the tear-line of the tear-off strip and of the hinge line the tear-off strip will be preferentially removed while the hinge line retained in tact. Further, in this embodiment placement of the hinge line and cutter bar on the front panel of the lid will necessarily be repositioned so as to assure that the width of the cutting edge protector means is sufficient to overlap the cutting edge of the cutter bar.

Referring to FIG. 4, FIG. 4 is a inner surface plan view of the carton blank used to form dispensing carton 10 of FIG. 1 showing front wall 19, bottom wall 15, rear wall 13, top panel 12 of the lid and cutter bar support means 24 all connected along respective fold lines 60 and each of the walls having tab members A which are folded upon each other and affixed in place by glue or other means to form the carton blank into a carton as shown in FIG. 1 and FIG. 2. Protective means 54 shown on the inner surface of cutter bar support means 24 may be provided to protect a film retaining means (not shown) provided on the front wall to adhere to the leading edge of the sheet material after removal of a preselected length of sheet material 40. Cutter bar 50 is shown as affixed to the inner surface of front panel of the lid by affixing means 58 which may be metal bars or rivets as hereto employed in the prior art. Tab means 32 and slot 33 are shown which comprise locking means for maintaining the lid of assembled dispensing carton 10 in a closed position when tab means 32 is inserted into slot 33.

Figure 5:
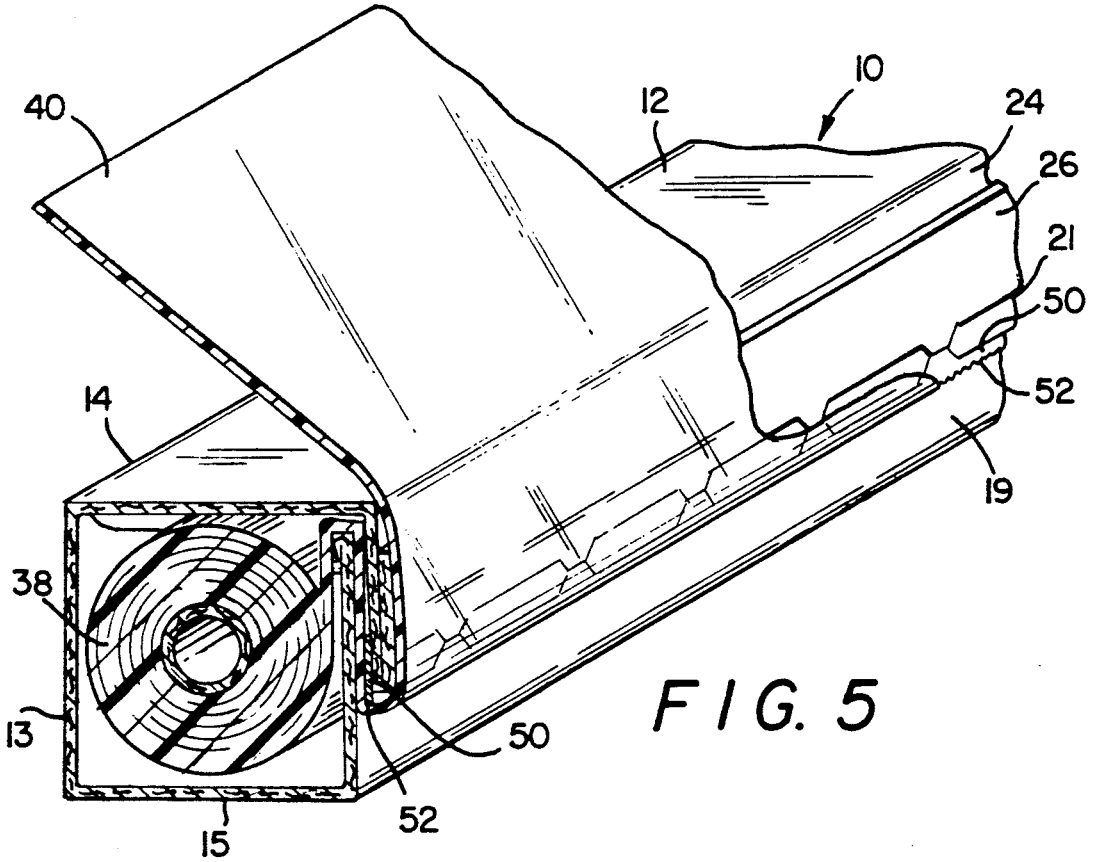
FIG. 5 is a perspective view of the dispensing carton of FIG. 1 with the lid closed while sheet material is being dispensed from the dispensing carton.

Referring to FIG. 5, carton 10 is shown during the dispensing of sheet material 40 from roll 38 as sheet material 40 from roll 38 as sheet material 40 passes in a counter clockwise direction over front wall 19 and between front wall 19 and cutter bar support means 24 downward to cutting edge 52 of cutter bar 50 and then upward against the inner surface of cutting edge protector means 26 which has been first outwardly deflected away from cutting edge 52 and then inwardly deflected along hinge line 21 towards cutter bar support means 24 whereby sheet material 40 contacts cutting edge 52 owing to the placement of hinge line 21 behind cutting edge 52 of cutter bar 50.

Referring to FIG. 6, a front view of dispensing carton 10 is shown except sheet material 40 has not been unwound from roll 38 of sheet material 40. This view shows the status of dispensing carton 10 after glue areas 46 and 48 have been ruptured and lid 17 raised to provide access to roll 38. Film retaining means 56 is provided on the inner surface 24 of cutter bar support means 24 and is aligned to mate with protective means 54 (on the outer surface of front wall 19) for film retaining means 56 when dispensing carton 10 is in a closed configuration.

Figure 9:
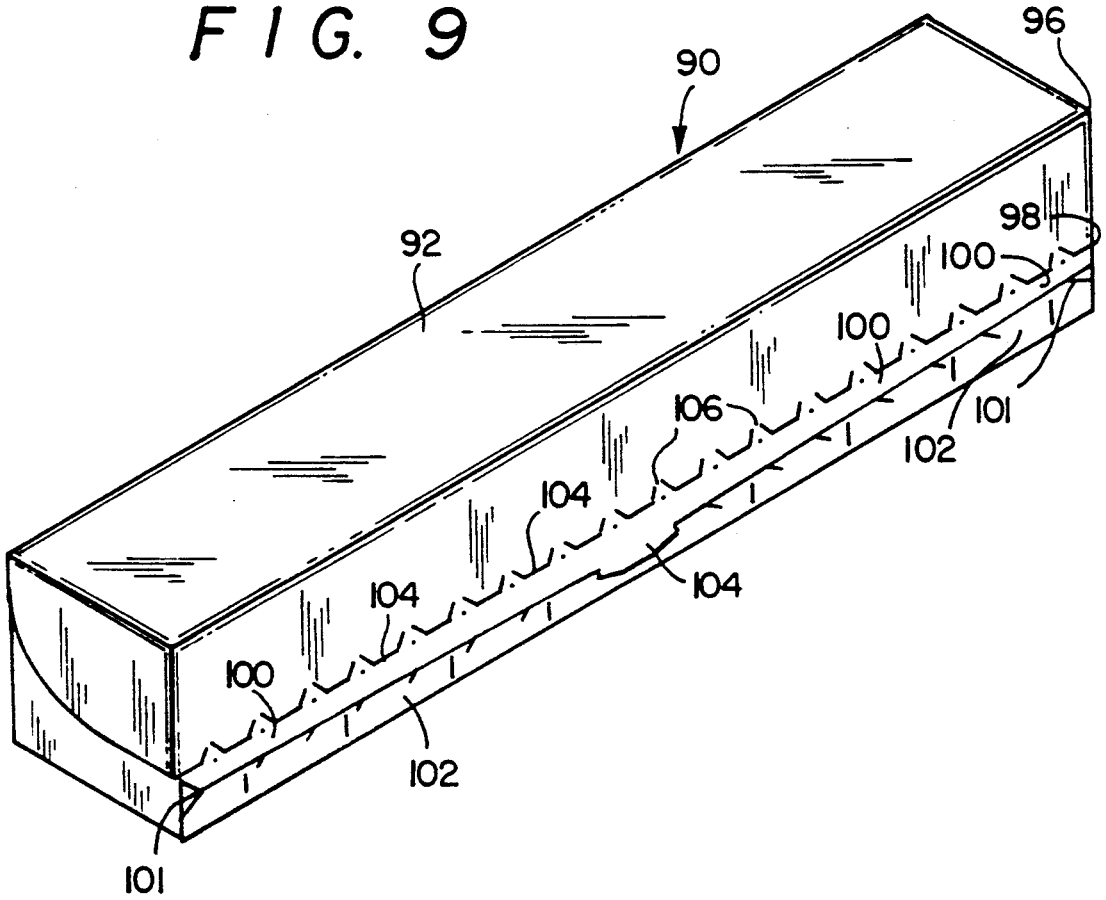
FIG. 9 is an isometric front view of a dispensing carton according to the instant invention showing the lid in a closed configuration with a single pieced tear-off strip.

FIG. 9 shows another embodiment of a dispensing carton 90 having a front panel 94 with a tear-off strip 102. In this embodiment the lower portion of the front panel of the lid is provided with a single pieced tear-off strip 102 whereby a portion of the front panel below hinge line 98 may be removed when opening dispensing carton 90 for the first time while at the same time a cutting edge protector means 100 is retained and connected at hinge line 98 and provides cutting edge protector means 100 according to the instant invention. The lower portion of the front panel below hinge line 98 will comprise cutting edge protector means 100 and tear-off strip 102 is removed from dispensing carton 90 by rupturing tear-off line 101 whereby cutting edge protector means 100 and tab 104 are retained as elements of dispensing carton 90 after opening. Tear-off strip 102 will typically be affixed to the front wall of dispensing carton 90 by glue areas (not shown) which will be ruptured during the removal of tear-off strips 102. The other features of the dispensing carton shown in FIG. 9 may be as shown in FIGS. 1 through 7 hereof.

In the embodiment shown in FIG. 9 it will be necessary to consider the propensity to rupturing of the line of perforations employed for the tear-off strip in comparison to any propensity of the hinge line to rupture. By proper selection of the form of the tear-line of the tear-off strip and of the hinge line the tear-off strip will be preferentially removed while the hinge line retained in tact. Further, in this embodiment the placement of the hinge line and cutter bar on the front panel of the lid will necessarily be repositioned so as to assure that the width of the cutting edge protector means is sufficient to overlap the cutting edge of the cutter bar.

The materials of construction for the dispensing carton of the instant invention are well known in the prior art. Such materials of construction are well known and are disclosed in U.S. Pat. Nos. 3,531,032, 3,552,614, 3,613,979, 3,722,767 and 4,307,828; incorporated herein by reference.

What is claimed:

1. A dispensing carton for a roll of sheet material comprising a bottom, front, rear and end walls, a lid hingedly connected to the rear wall forming an elongated aperture between the lid and the front wall for withdrawing a sheet material from a roll of sheet material positioned within the dispensing carton, said lid comprising a first panel and a second panel, said first panel extending from said rear wall to said front wall and said second panel overlapping the front wall and having a cutting means with a cutting edge affixed thereto, said second panel having an inner surface, a top edge and a bottom edge with a hinge line placed between said top edge and bottom edge whereby said second panel may be bent at said hinge line to form a cutting means support means and a cutting edge protector means along said hinge line and adjacent said cutting edge of said cutting means with said hinge line being located behind said cutting edge and said cutting edge protector means having at least one tear-off strip portion for use in opening said dispensing carton whereby when said tear-off strip is removed upon opening said cutting edge protector means is retained along said hinge line overlaying said cutting edge of said cutting means whereby during use of said dispensing carton said cutting edge protector means overlays said cutting edge of said cutting means.

2. A dispensing carton according to claim 1 wherein said hinge line is a line of spaced apart perforations.

3. A dispensing carton for a roll of sheet material according to claim 2 wherein said spaced apart perforations are hinging perforations.

4. A dispensing carton according to claim 1 wherein said second panel is a single sheet material and said hinge line is a line of spaced apart perforations in said single sheet of material forming said second panel.

5. A dispensing carton according to claim 4 wherein said spaced apart perforations are three sided perforations.

6. A dispensing carton according to claim 1 wherein said cutting means and associated hinge line behind the cutting edge of said cutting means are located closer to said bottom edge than said top edge of said second panel.

7. A dispensing carton according to claim 1 wherein said cutting edge protector means has a tab means at said bottom edge with cut-out portions on each side of said tab means.

8. A dispensing carton according to claim 7 wherein said front panel has a slot for engagement by said tab means whereby the dispensing carton is retained in a closed configuration.

9. A dispensing carton according to claim 7 wherein said cut-out portions are inwardly extending from said bottom edge in an arcuate direction terminating at said respective sides of said tab means.

10. A dispensing carton according to claim 1 wherein said cutting means is a cutting bar.

11. A dispensing carton according to claim 1 wherein the inner surface of said second panel has affixed thereto at least one glue area capable of being ruptured for access to said roll of sheet material.

12. A dispensing carton according to claim 1 wherein the inner surface of said cutting means support means has affixed thereto protecting means for film retaining means on said front wall and said film retaining means and protecting means are in contact when said inner surface of said cutting means support means is in contact with an outer surface of said front wall when the dispensing carton is in a closed configuration.

13. A dispensing carton according to claim 1 wherein said second panel overlaps said front wall for a major portion of the total vertical distance of said front wall.

14. A dispensing carton for a roll of sheet material comprising a bottom, front, rear and end walls, a lid hingedly connected to the rear wall forming an elongated aperture between the lid and the front wall for withdrawing a sheet material from a roll of sheet material positioned within the dispensing carton, said lid comprising a first panel and a second panel, said first panel extending from said rear wall to said front wall and said second panel overlapping the front wall for a major portion of the total vertical distance of said front wall having an inner surface and an outer surface and said second panel having a cutting means with a cutting edge affixed to said inner surface, said second panel having a top edge and a bottom edge with a hinge line placed between said top edge and bottom edge whereby said second panel may be bent at said hinge line to form a cutting means support means having an inner surface and an outer surface and a cutting edge protector means having an inner surface and an outer surface along said hinge line and adjacent said cutting edge of said cutting means with said hinge line being located behind said cutting edge and said cutting edge protector means overlays said cutting edge of said cutting means, said inner surface of said cutting means support means having protective means for film retaining means on the outer surface of said front wall, said outer surface of said front wall and said inner surface of said cutting edge protector means having glue areas for maintaining said dispensing carton in its closed configuration prior to first use and said cutting edge protector means and front wall having locking means for maintaining said dispensing carton in its closed configuration after first use and said cutting edge protector means having at least one tear-off strip portion for using in opening said dispensing carton whereby when said tear-off strip portion is removed upon opening said cutting edge protector means is retained along said hinge line overlaying said cutting edge of said cutting means.

15. A dispensing carton for a roll of sheet material comprising a bottom, front, rear and end walls, a lid hingedly connected to the rear wall forming an elongated aperture between the lid and the front wall for withdrawing a sheet material from a roll of sheet material positioned within the dispensing carton, said lid comprising a first panel and a second panel, said first panel extending from said rear wall to said front wall and said second panel overlapping the front wall for a major portion of the total vertical distance of said front wall having an inner surface and an outer surface and said second panel having a cutting means with a cutting edge affixed to said inner surface, said second panel having a top edge and a bottom edge with a hinge line placed between said top edge and bottom edge whereby said second panel may be bent at said hinge line located behind said cutting edge to form a cutting means support means having an inner surface and an outer surface and a cutting edge protector means overlaying the cutting edge of said cutting means and having a portion thereof as a tear-off strip having an inner surface and an outer surface, said inner surface of said tear-off strip having glue areas for maintaining said dispensing carton in its closed configuration prior to first use and said cutting edge protector means and front wall having locking means after removal of said tear-off strip for maintaining said dispensing carton in a closed configuration after first use.

16. A method for dispensing a sheet material from a dispensing carton containing a roll of sheet material, said dispensing carton comprises a bottom, front, rear and end walls, a lid hingedly connected to the rear wall forming an elongated aperture between the lid and the front wall for withdrawing a sheet material from a roll of sheet material positioned within the dispensing carton, said lid comprising a first panel and a second panel, said first panel extending from said rear wall to said front wall and said second panel overlapping the front wall and having a cutting means with a cutting edge affixed thereto, said second panel having an inner surface, a top edge and a bottom edge with a hinge line placed between said top edge and bottom edge whereby said second panel may be bent at said hinge line to form a cutting means support means and a cutting edge protector means along said hinge line and adjacent said cutting edge of said cutting means with said hinge line being located behind said cutting edge wherein said method comprises opening said dispensing carton and dispensing said sheet material therefrom with said cutting edge protector means overlaying said cutting edge of said cutting means during said dispensing of said sheet material.

* * * * *